US006247188B1

(12) United States Patent
Béland

(10) Patent No.: US 6,247,188 B1
(45) Date of Patent: Jun. 19, 2001

(54) ADJUSTABLE SHOULDER PAD

(75) Inventor: Jean-François Béland, Saint-Laurent (CA)

(73) Assignee: Bauer Nike Hockey, Inc., Montreal (CA)

( * ) Notice: Subject to any disclaimer, the term of this patent is extended or adjusted under 35 U.S.C. 154(b) by 0 days.

(21) Appl. No.: 09/642,271

(22) Filed: Aug. 18, 2000

(30) Foreign Application Priority Data

Aug. 30, 1999 (CA) ..... 2281141

(51) Int. Cl.[7] ..... A41D 27/26
(52) U.S. Cl. ..... 2/461; 2/462
(58) Field of Search ..... 2/461, 459, 462, 2/463, 467, 268, 908, 92

(56) References Cited

U.S. PATENT DOCUMENTS

| | | | |
|---|---|---|---|
| 653,544 | * | 7/1900 | Burns et al. . |
| 1,687,120 | * | 10/1928 | Goldsmith . |
| 1,970,130 | * | 8/1934 | Dickenson . |
| 2,545,039 | | 3/1951 | Mitchel . |
| 3,088,115 | * | 5/1963 | Groot . |
| 3,509,579 | * | 5/1970 | Morgan . |
| 3,867,726 | * | 2/1975 | Owl et al. . |
| 4,501,023 | | 2/1985 | Bilberry . |
| 4,516,273 | * | 5/1985 | Gregory et al. . |
| 4,590,622 | | 5/1986 | Wolfe et al. . |
| 4,610,035 | | 9/1986 | Mattila . |
| 4,654,893 | * | 4/1987 | Meyers et al. . |
| 4,675,912 | * | 6/1987 | Kirkland . |
| 4,697,285 | | 10/1987 | Sylvester . |
| 4,821,339 | * | 4/1989 | Fair . |
| 4,982,447 | * | 1/1991 | Henson . |
| 4,996,720 | * | 3/1991 | Fair . |
| 5,007,108 | | 4/1991 | Laberge et al. . |
| 5,065,457 | | 11/1991 | Henson . |
| 5,173,964 | * | 12/1992 | Ball et al. . |
| 5,204,993 | | 4/1993 | Siemens . |
| 5,623,728 | | 4/1997 | Wagner . |
| 5,987,654 | * | 11/1999 | Chartrand ..... 2/462 |

OTHER PUBLICATIONS

Velcro Product News, Feb. 1975, PN No. 11.*

* cited by examiner

*Primary Examiner*—Rodney M. Lindsey
(74) *Attorney, Agent, or Firm*—Ratner & Prestia

(57) ABSTRACT

An adjustable shoulder pad particularly adapted for use by children for playing hockey and other similar sports. The adjustable junior shoulder pad is made of two main portions, namely a left-hand portion and a right-hand portion. These two main portions have front and rear panels interconnected together by a shoulder arch and these panels have respective overlapping surfaces. The overlapping surfaces of the front and rear panels have affixing means which allow interconnection of the right and left portions in accordance with different positions for allowing size adjustment of the shoulder pad.

14 Claims, 10 Drawing Sheets

ADJUSTABLE SHOULDER PAD

FIELD OF THE INVENTION

The invention relates to an adjustable protective garment for shielding and at least partially protecting the upper torso of a player from impacts by extraneous objects. The invention is particularly although not exclusively directed to the provision of protective pads in the form commonly referred to as "shoulder pads" as used for playing hockey and other sporting activities. The invention is also concerned with hockey shoulder pads used by children during their years of growth.

BACKGROUND OF THE INVENTION

A conventional shoulder pad as used by ice hockey players comprises a series of padded sections to protect the chest, back, shoulder and upper arm regions of the player, these sections being interconnected or in some instances integrated into a fabric carrier so that they may be put on and removed altogether. Typically in such shoulder pad, the front chest protecting panels meet in the region of the sternum of the player and are interconnected by means of laces, while the rear protecting panels meet in the region of the spine and are interconnected by means of straps. Other types of shoulder pads may comprise one-piece front and rear panels which are sized to cover the player's chest and back respectively. Shoulder pads are usually sold in four different sizes i.e. small, medium, large and X-large, and for two different types of players i.e. Junior and Adult. Usually, the size of a shoulder pad is fixed, but some prior shoulder pads allowed adjustments.

U.S. Pat. No. 2,545,039 discloses a shoulder pad having a connecting member which connects the rear left and rear right sections together. More particularly, this connecting member comprises at each end upper and lower slots having different branches for receiving a screw. In use, the player may insert the screws in one of the different branches in order to connect together the rear sections at an appropriate space distance from each other. While this prior shoulder pad provide a certain level of adjustment, it requires use of bolts, screws, nuts or another element for securing together the two rear sections. Furthermore, no real adjustment is provide at the front of the shoulder pad since the front sections are simply interconnected together by lacing, and there is then no protection between those front sections in the sternum area.

Thus, there is a need in the industry for a shoulder pad which provides an easier way to adjust and secure together the different adjustable portions of the shoulder pad while allowing a good protection level. There is also a need for an adjustable junior shoulder pad which offers a sufficient degree of adjustment to be usable for many seasons while in the child's years of growth.

It is an object of the present invention to provide an adjustable shoulder pad including right and left main portions, each main portions having front and rear panels interconnected together by a shoulder arch, said panels having respective overlapping surfaces comprising affixing means wherein said right and left portions may be interconnected by affixing together said respective overlapping surfaces while allowing size adjustment of said shoulder pad.

It is also an object of the present invention to provide a junior shoulder pad for hockey players which offers a considerable degree of size adjustment for the child's years of growth.

In a preferred embodiment of the present invention, the overlapping surfaces comprise loops and hooks sections for affixing together the front and rear panels.

Other objects and features of the invention will become apparent by reference to the following specification and to the drawings.

BRIEF DESCRIPTION OF THE DRAWINGS

A detailed description of the preferred embodiment of the invention is provided herein with reference to the following drawings, wherein.

Figure 1:
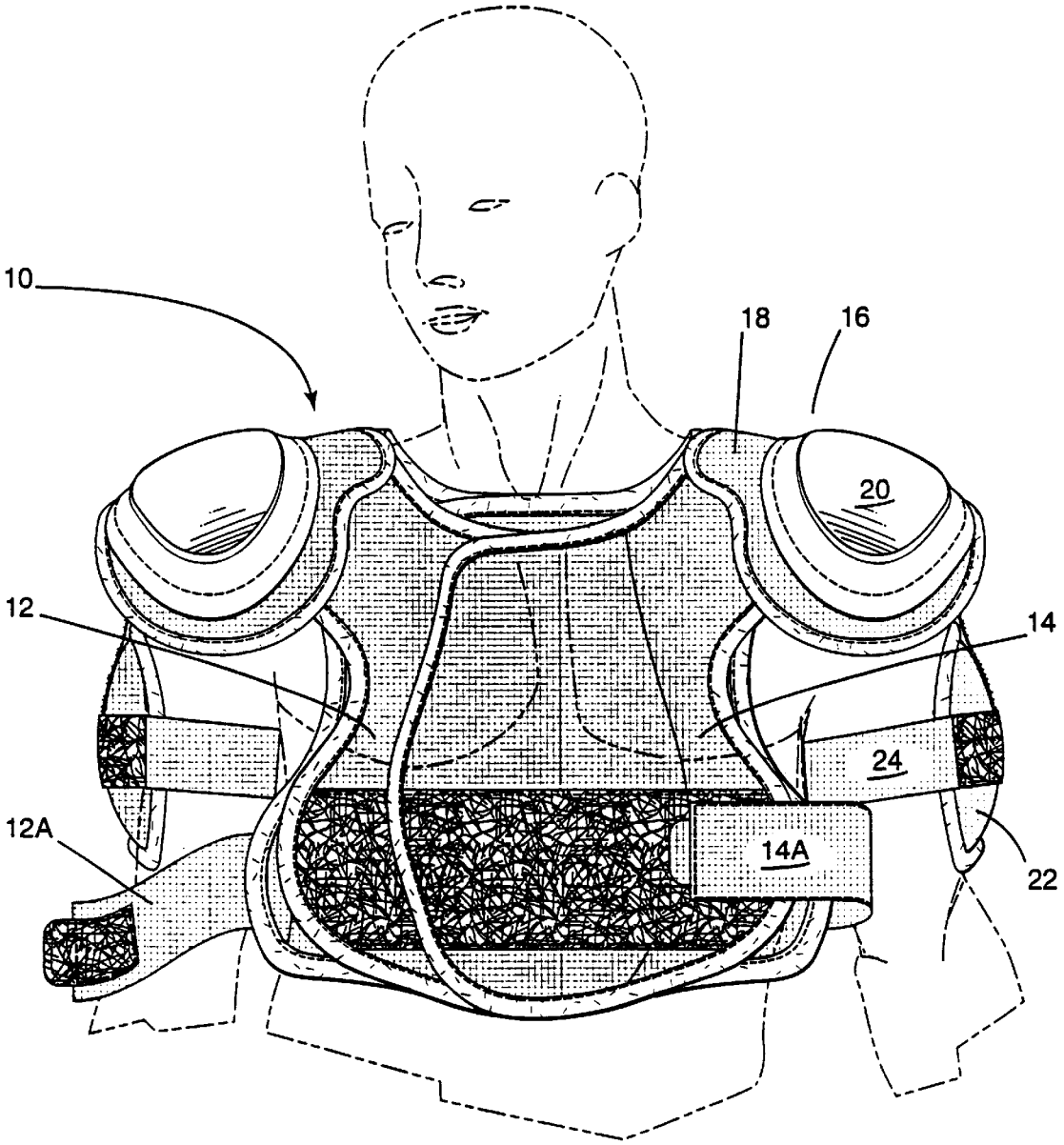
FIG. 1 is a front elevational view of an adjustable shoulder pad constructed in accordance with the invention.

In the drawings, the preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENTS

Figure 2:
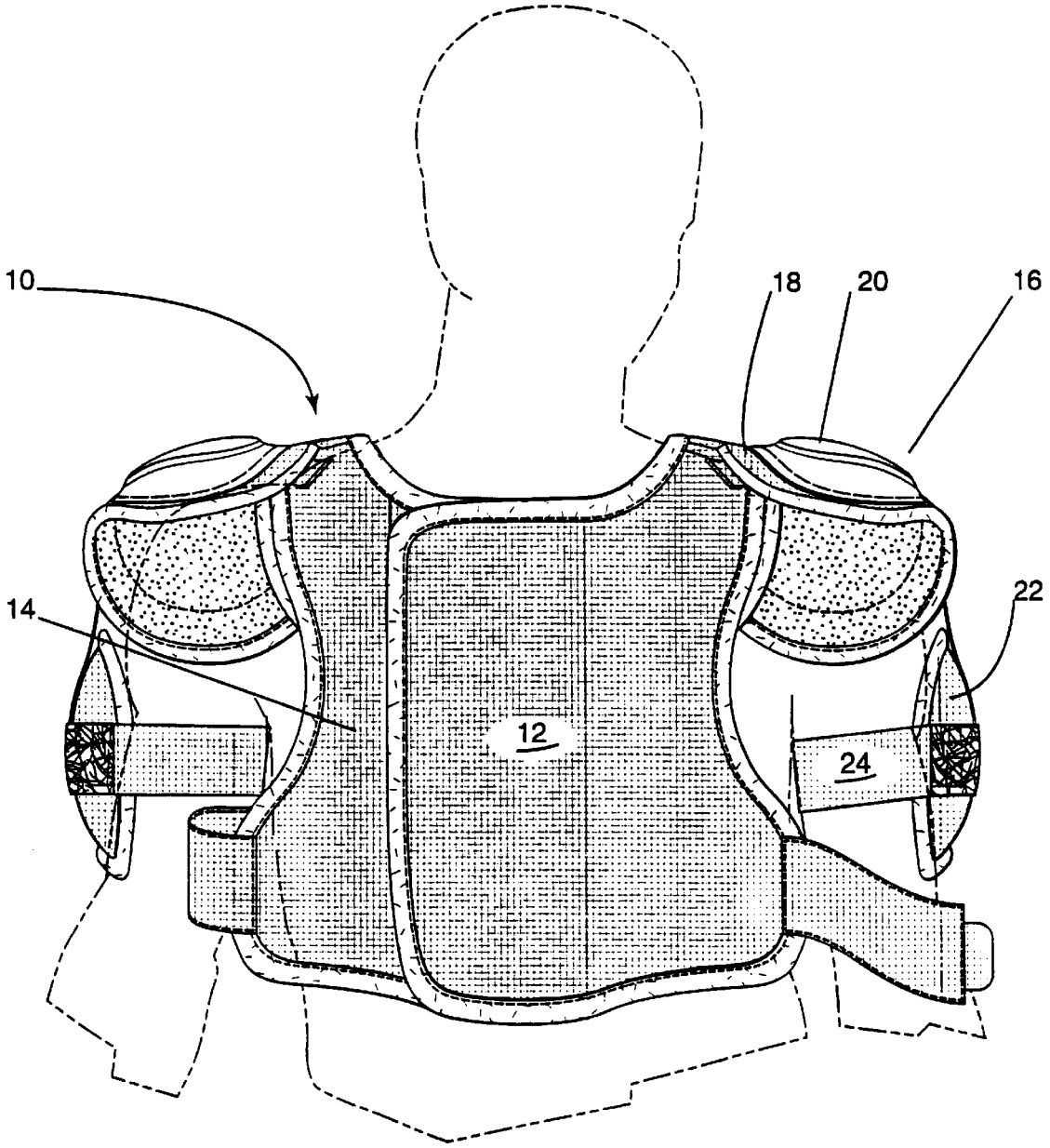
FIG. 2 is a rear elevational view of the shoulder pad illustrated in FIG. 1.
Figure 3:
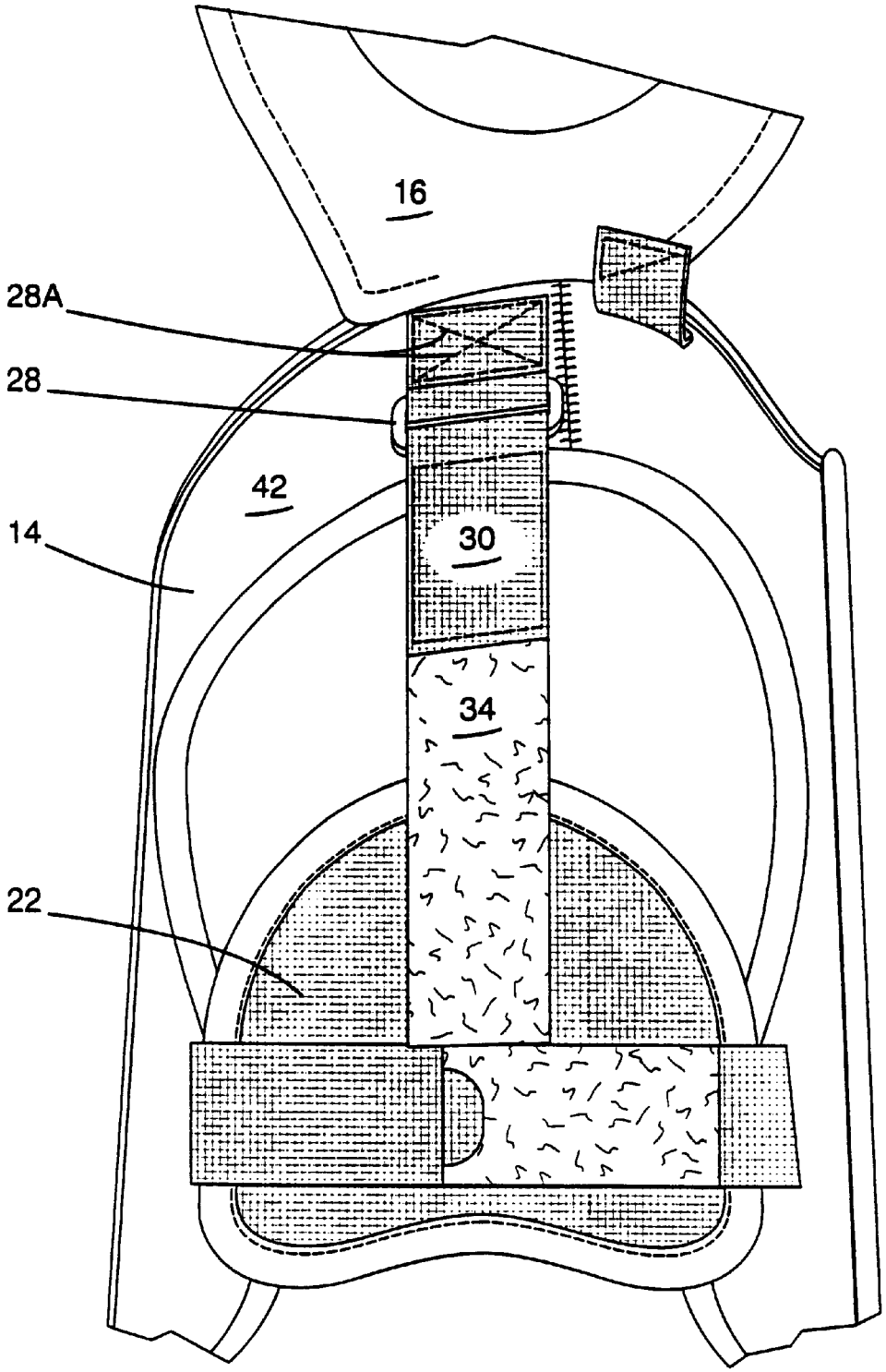
FIG. 3 is a fragmentary end view of the shoulder pad of FIGS. 1 and 2 showing the connecting element for the biceps pad.
Figure 4:
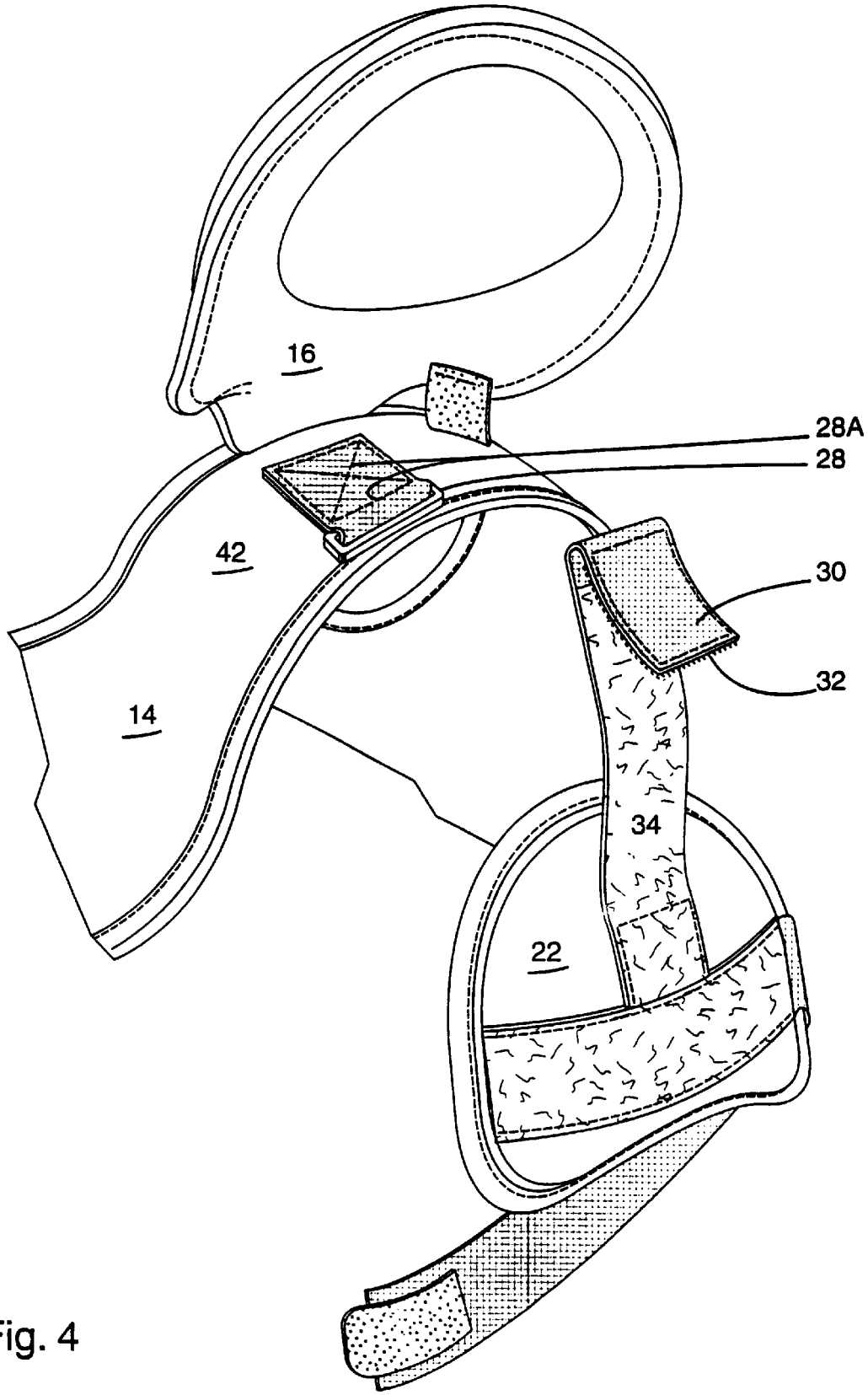
FIG. 4 is a fragmentary exploded view showing some of the components illustrated in FIG. 3.

FIGS. 1 to 4 illustrate an adjustable shoulder pad constructed in accordance with the present invention which is generally designated by the reference numeral 10. The shoulder pad 10 includes right and left main portions 12 and 14. One of these main portions 12 and 14 may be the mirror image of the other in order to reduce the cost of manufacture. Main portions 12 and 14 can be of any suitable material or composition to provide the degree of cushioning and protection that is desired. For example, they can be formed from a relatively thick foam material covered by layers of woven synthetic yarn. More particularly, the portions 12 and 14 may comprise a closed cell foam of ethylene vinyl acetate of a thickness of 6.5 mm covered by mesh outer layers of a woven synthetic material such as polyester. External shells made of relatively stiff material may also be riveted or sewn to these portions 12 and 14, or similar internal shells may be inserted therein, in order to provide added protection in selected areas such as the rib cage and the spine of the player.

Furthermore, the shoulder pad 10 comprises shoulder protectors 16, each having a shoulder liner 18 and a molded curved shoulder cap 20 which is usually sewn to the liner 18. The shoulder pad 10 also comprises biceps pads 22, each having an elasticized strap loop 24 to position the biceps pad 22 in relation to the player's arm. As best seen on FIGS. 3 and 4, a hooks and loops fastening arrangement provided on the shoulder pad 10 enables vertical adjustment of the biceps pads 22. A suitable hooks and loops fastener is sold under the trade-mark "VELCRO". Each main portion 12, 14 carries a ring 28 to which is attached an adjustable strap 30 to which biceps pads 22 is suspended. Hooks and loops sections 32 and 34 are provided on adjustable straps 30. In use, the end of strap 30 is passed through the ring 28 and at the desired length, it is folded over. The player then presses together the loops and hooks sections 32 and 34 for obtaining the desired position of the biceps pads 22 with respect to the arms. Adjustable straps 30 determine the height of biceps pads 22 with respect to the corresponding main portion 12 or 14. Each ring 28 is held in place by means of strip of textile material sewn to the corresponding shoulder arch as at 28A.

Figure 5:
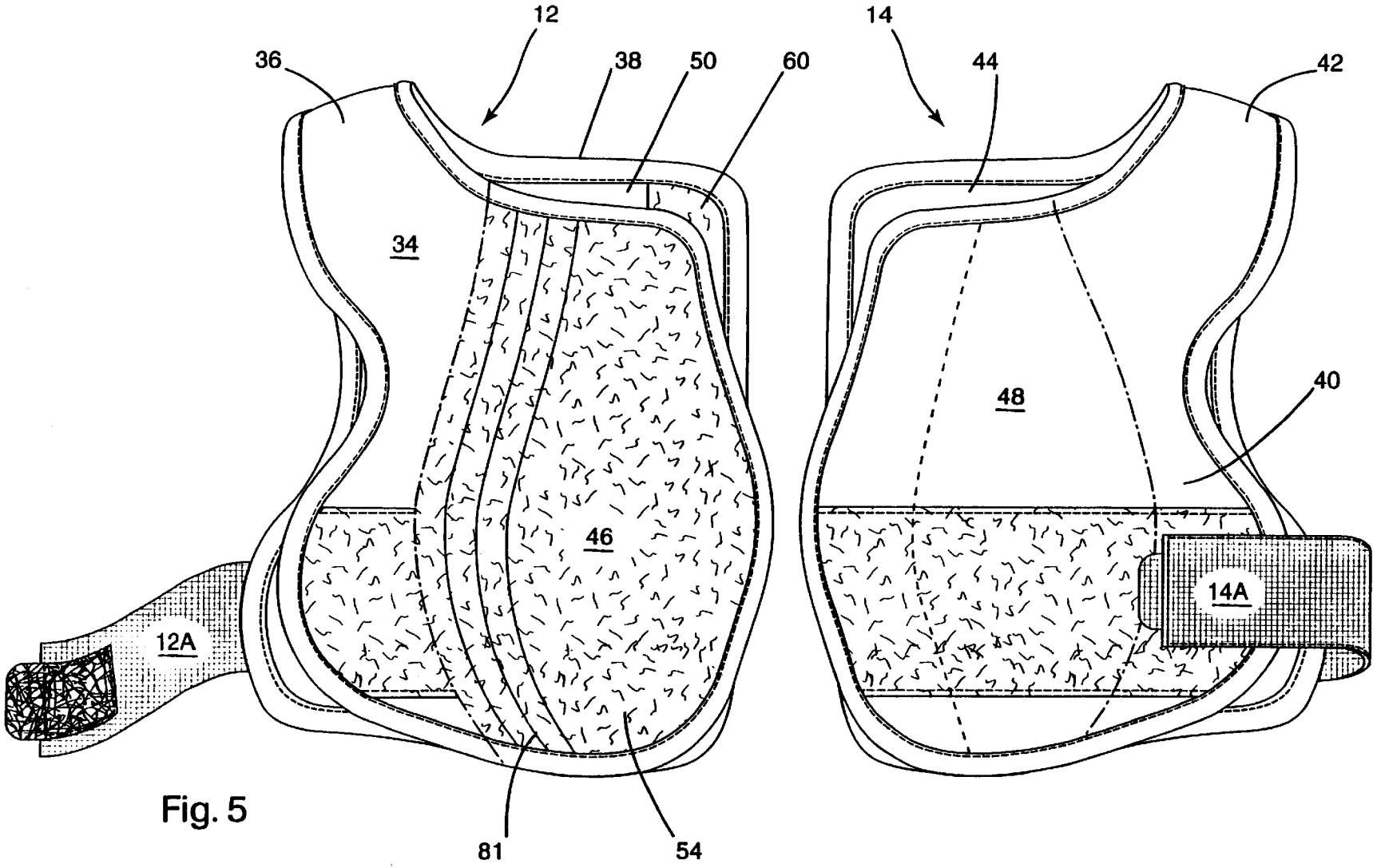
FIG. 5 is a front elevational view of right and left main portions of the shoulder pad in accordance with the invention, wherein the two main portions are not interconnected and a number of secondary components are not illustrated.
Figure 6:
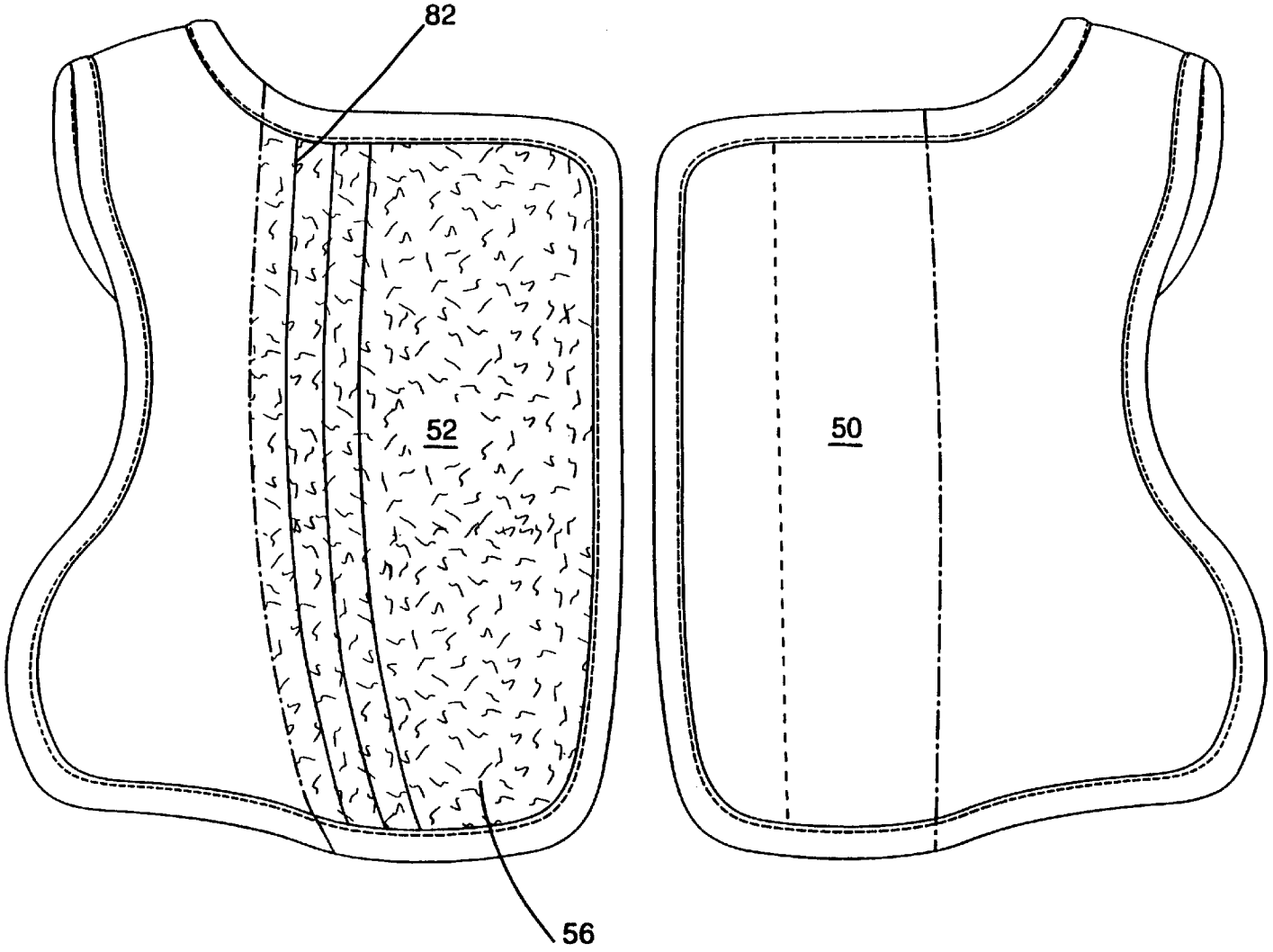
FIG. 6 is a rear elevational view of right and left main portions of the shoulder pad as illustrated in FIG. 5.
Figure 7:
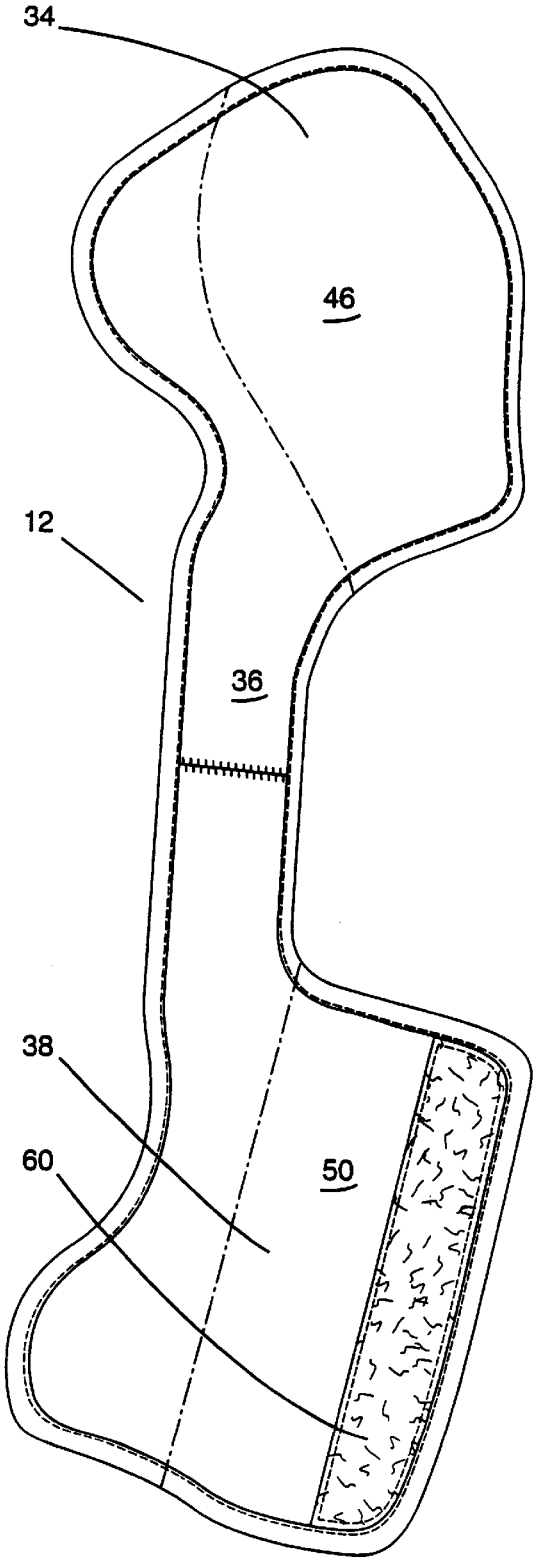
FIG. 7 is an inside view of the right main portion of the shoulder pad wherein secondary components are not illustrated.
Figure 8:
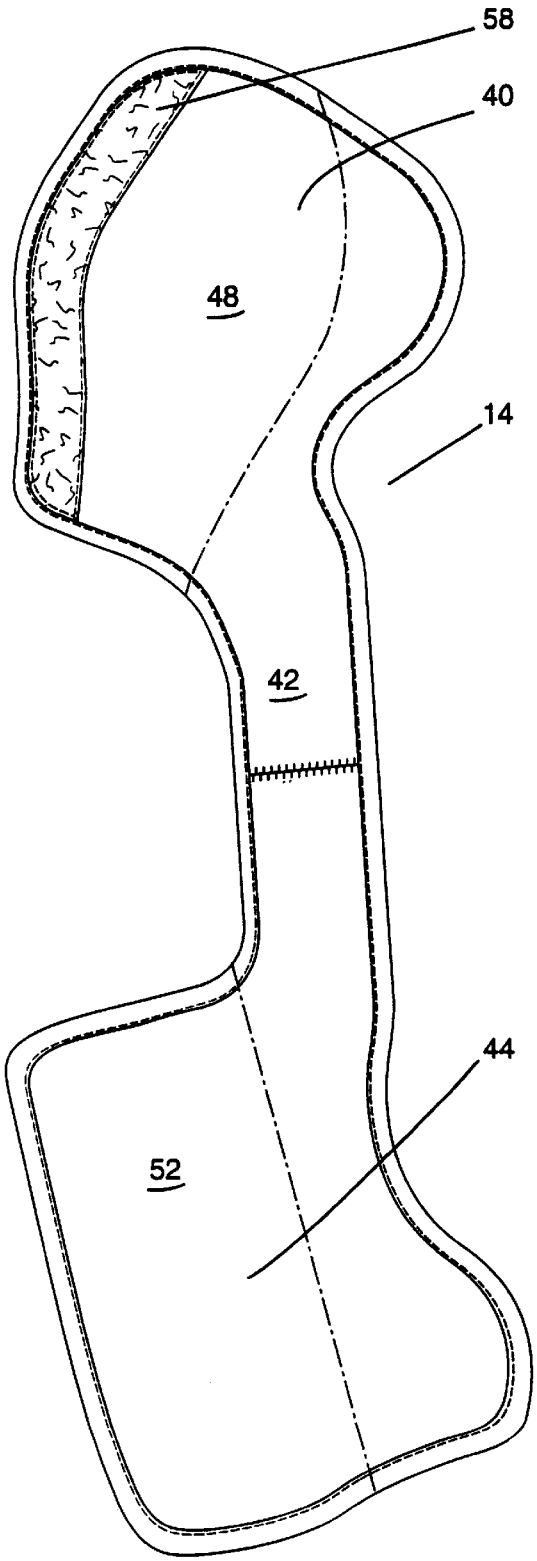
FIG. 8 is an inside view of the left main portion of the shoulder pad wherein secondary components are not illustrated.

With reference to FIGS. 5 to 8 illustrating the right and left main portions 12 and 14 alone and spaced apart, the left portion 12 comprises front panel 34 and rear panel 38 interconnected by an interconnecting shoulder arch 36 and retained by a lateral adjustable strap 12A of any suitable construction, preferably using hooks and loops fastener as shown. Similarly, the right-hand main portion 14 comprises front and rear panels 40 and 44 interconnected by an interconnecting shoulder arch 42 and retained by a lateral adjustable strap 14A similar to the strap 12A. As is well known in the art, the front panels 34 and 40 are sized to cover the right and left sides of the player's chest from the shoulder region down as far as the bottom of the rib cage. The rear panels 38 and 44 are shaped somewhat similarly to the front panels 34 and 40.

The front panels 34 and 40 have respective overlapping surfaces 46 and 48, and similarly, rear panels 38 and 44 have respective overlapping surfaces 50 and 52. One will appreciate that the superposing of the overlapping surfaces 46 and 48, and 50 and 52, provide an additional protection in the sternum and spine areas respectively.

The overlapping surfaces 46 and 52 comprise respective loops sections 54 and 56 while overlapping surfaces 48 and 50 comprise respective hooks sections 58 and 60. By pressing together the hooks and loops sections 58 and 54, front panels 40 and 34 are affixed together, while, similarly by pressing together the hooks and loops sections 60 and 56, rear panels 38 and 44 are affixed together. Overlapping surfaces 46 and 48, 50 and 52 have a considerable surface area, such as, about half the length of each panel and full width. By varying the position of the front panel 40 with respect to the front panel 34, and by pressing together hooks and loops sections 58 and 54 when the appropriate position is obtained, the size of the shoulder pad 10 around the chest area may thus be adjusted and an excellent adjustable joint of the mating parts is obtained. In the same manner, by varying the position of the rear panel 38 with respect to the rear panel 44, and by pressing together hooks and loops sections 60 and 56 when the appropriate position is obtained, the size of the shoulder pad 10 around the back area may thus be adjusted. Hence, the right and left portions 12 and 14 can be adjustably connected together for varying the size of the shoulder pad 10. In that sense, the shoulder pad 10 may be worn by different players or by the same player while his body grows. Adjustment lines 81 and 82 are provided on loops sections 54 and 56 respectively. Lines 81 and 82 provide a means of measurement to the wearer when adjusting the size of shoulder pad 10 to ensure repeatability of the adjustment and to help evenly connect the front and back of right and left portions 12 and 14.

Figure 9:
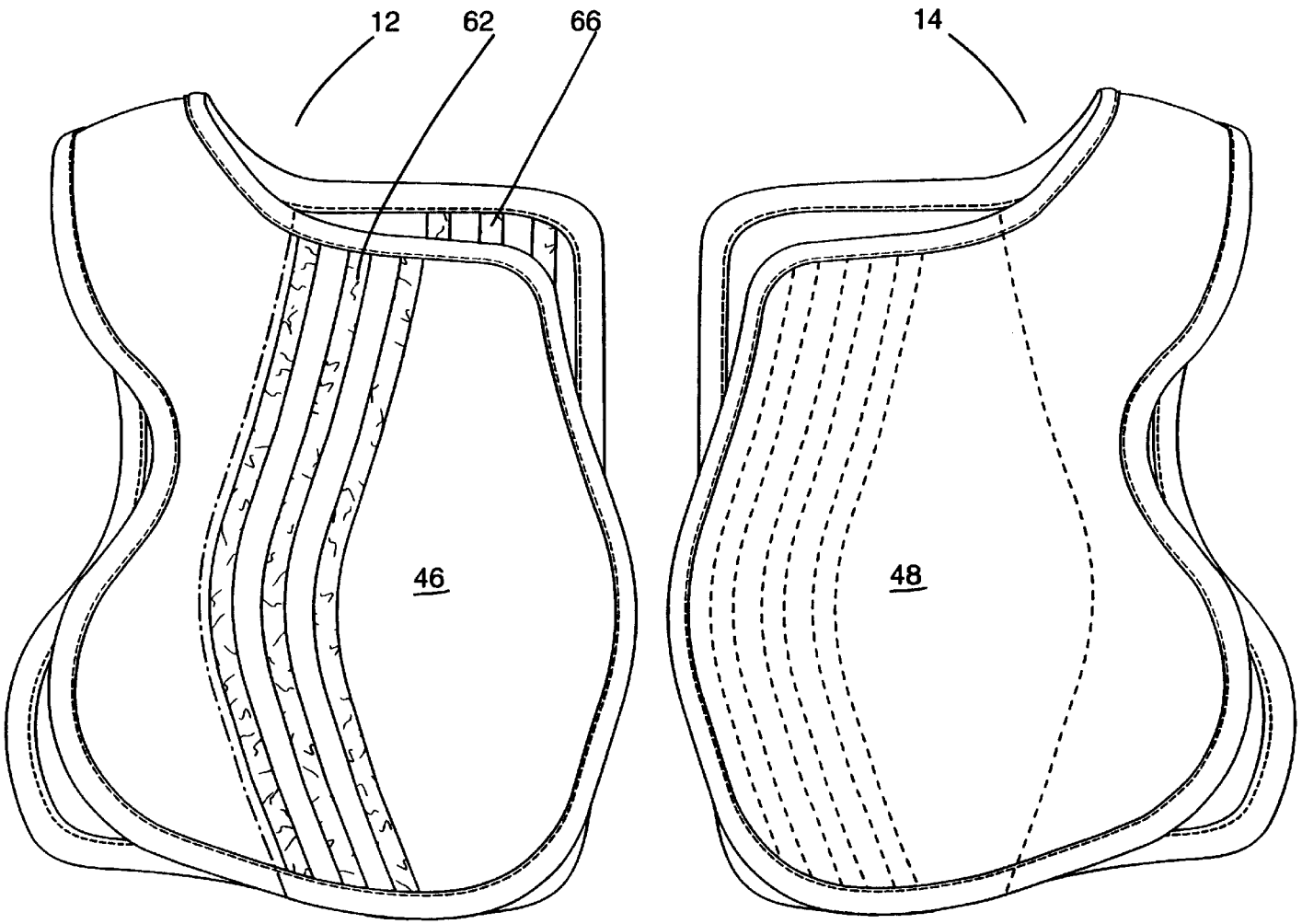
FIG. 9 is a front elevational view of right and left main portions of a second embodiment of the shoulder pad constructed in accordance with the invention, wherein the two main portions are not interconnected and a number of secondary components are not illustrated.
Figure 10:
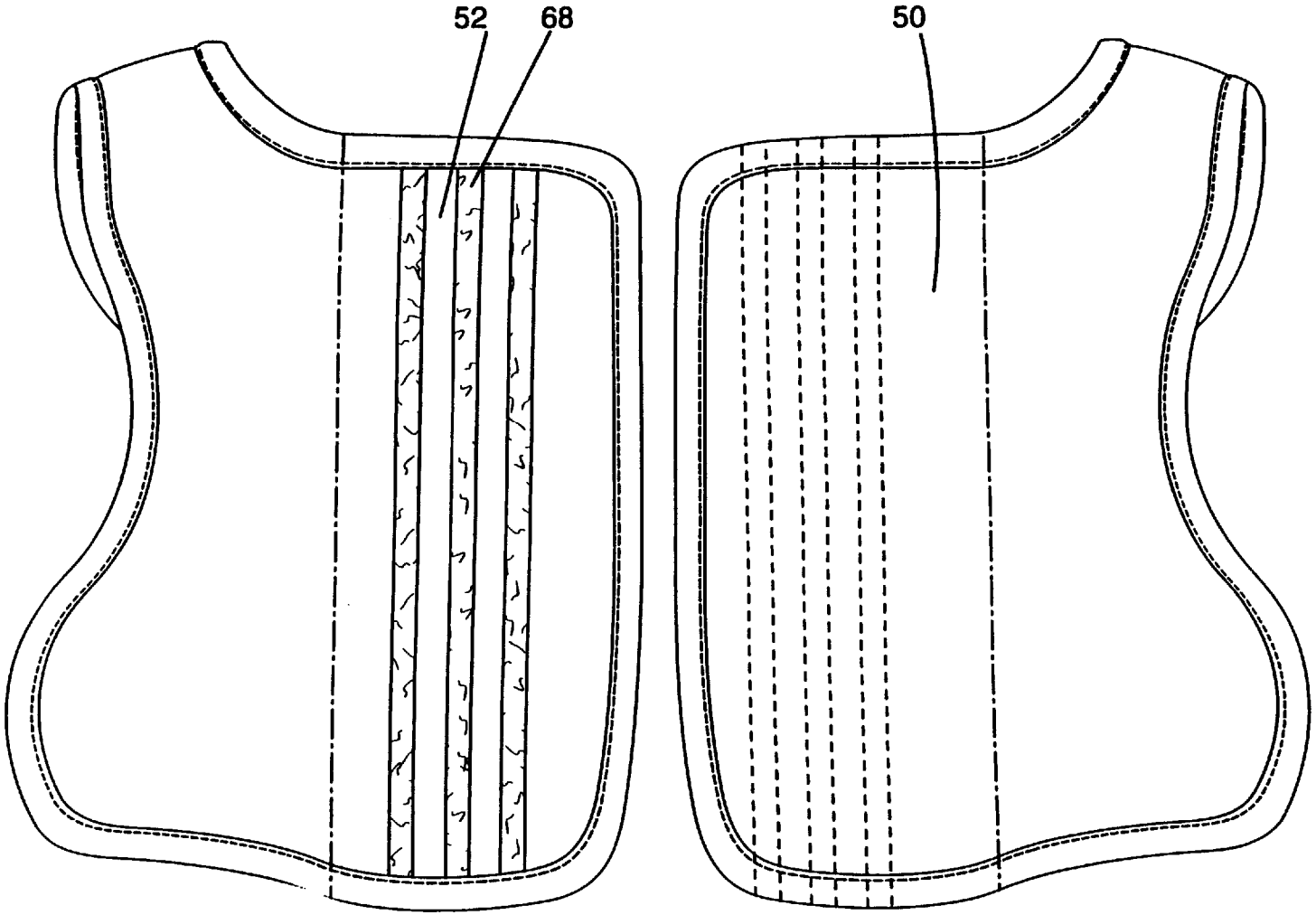
FIG. 10 is a rear elevational view of right and left main portions of the shoulder pad illustrated in FIG. 9, wherein the two main portions are not interconnected and a number of secondary components are not illustrated.
Figure 11:
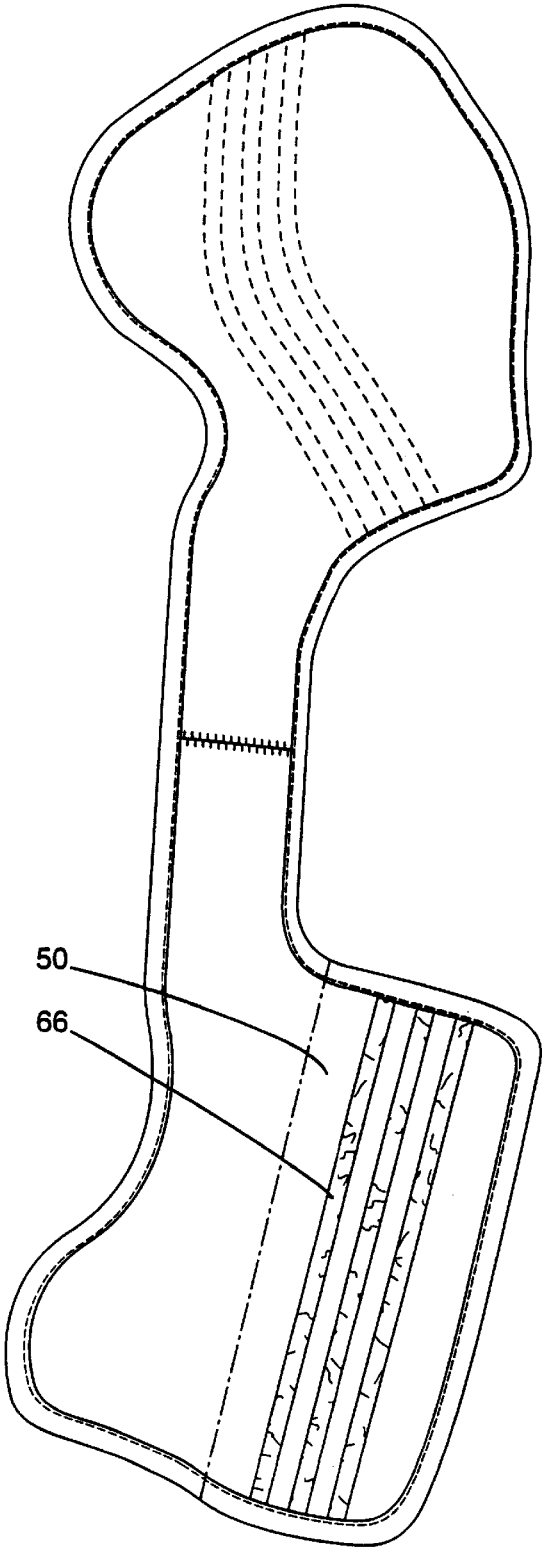
FIG. 11 is an inside view of the right main portion of the shoulder pad illustrated in FIG. 9.
Figure 12:
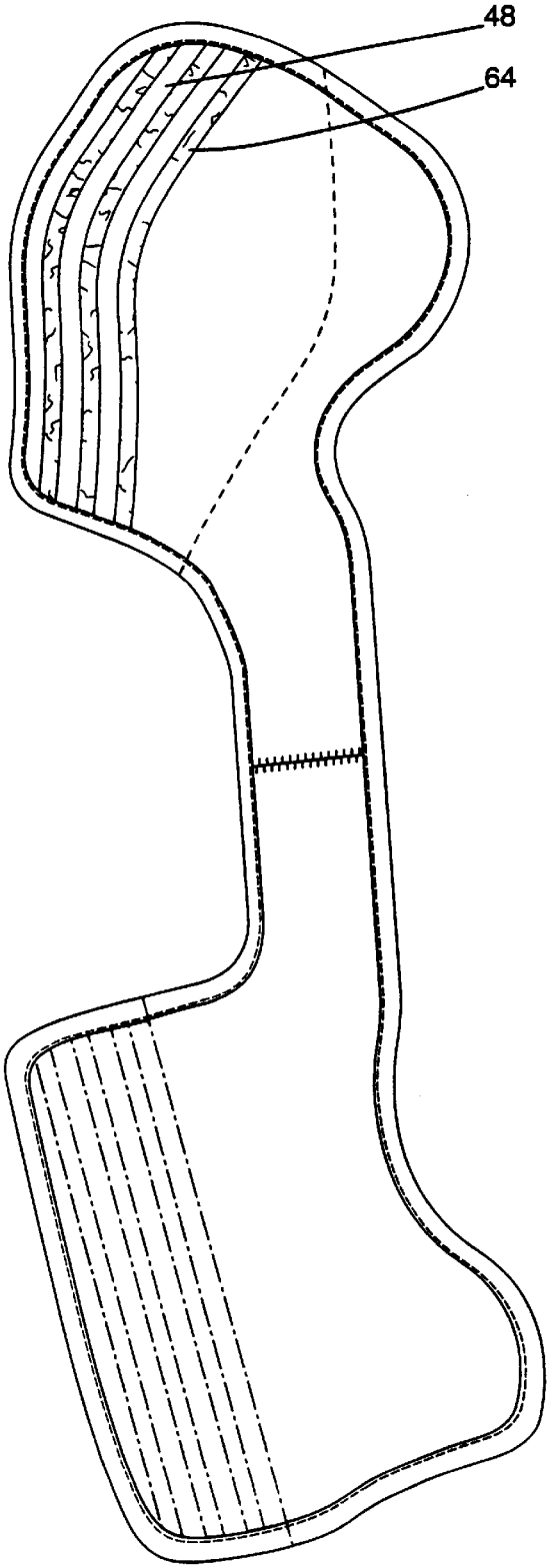
FIG. 12 is an inside view of the left main portion of the shoulder pad illustrated in FIG. 9.

FIGS. 9 to 12 illustrate right and left portions 12 and 14 comprising overlapping surfaces constructed in accordance with a variant. More particularly, each front overlapping surfaces 46 and 48 comprises three longitudinal bands 62 with loops and three longitudinal bands 64 with hooks respectively, and each rear overlapping surfaces 50 and 52 comprises three longitudinal bands 66 with hooks and three longitudinal bands 68 with loops respectively. As described above, the right and left portions 12 and 14 can be adjustably connected together for varying the size of the shoulder pad 10. Here, the shoulder pad 10 can be adjusted in accordance with three different sizes.

It is understood that the shoulder pad can comprise shoulder protectors which offer protection for the upper arm region, an no biceps pads are thus required. Furthermore, these shoulder protectors can be adjustable with respect to the portions by means of adjustable straps having loops and hooks sections.

The above description of the preferred embodiment should not be interpreted in any limiting manner since variations and refinements are possible which are within the spirit and scope of the present invention. The scope of the invention is defined in the appended claim and their equivalents.

The embodiments of the invention for which an exclusive property or privilege is claimed are defined as follows:

1. An adjustable shoulder pad including right and left portions, each of said right and left portions having rear and front panels interconnected together by a shoulder arch, said rear and front panels having respective rear and front overlapping surfaces comprising affixing means wherein said right and left portions are interconnected by affixing together said respective rear and front overlapping surfaces while allowing size adjustment of said shoulder pad.

2. An adjustable shoulder pad as defined in claim 1, wherein said rear and front overlapping surfaces comprise loops and hooks sections.

3. An adjustable shoulder pad as defined in claims 1 or 2, wherein said right rear panel has an overlapping surface comprising a hooks section and said left rear panel has an overlapping surface comprising a loops section.

4. An adjustable shoulder pad as defined in claim 1 or 2, wherein said right front panel has an overlapping surface comprising a loops section and said left front panel has an overlapping surface comprising a hooks section.

5. An adjustable shoulder pad as defined in claim 1 or 2, wherein said right rear panel has an overlapping surface comprising at least two longitudinal bands with hooks and said left rear panel has an overlapping surface comprising at least two longitudinal bands with loops.

6. An adjustable shoulder pad as defined in claim 1 or 2, wherein said right front panel has an overlapping surface comprising at least two longitudinal bands with loops and said left front panel has an overlapping surface comprising at least two longitudinal bands with hooks.

7. An adjustable shoulder pad as defined in claim 1, wherein said shoulder pad comprises protectors.

8. An adjustable shoulder pad as defined in claim 7, wherein said shoulder protectors are adjustable with respect to said portions.

9. An adjustable shoulder pad as defined in claim 7 or 8, wherein each of said portions comprises a ring secured to said shoulder arch and each of said shoulder protectors comprises a strap having hooks and loops sections providing vertical adjustment of each of said shoulder protectors.

10. An adjustable shoulder pad as defined in claim 1, wherein said shoulder pad comprises at least one biceps pad.

11. An adjustable shoulder pad as defined in claim 10, wherein said at least one biceps pad is adjustable with respect to said portions.

12. An adjustable shoulder pad as defined in claim 10 or 11, wherein each of said portions comprises a ring secured to said shoulder arch and said at least one biceps pad comprises a strap having hooks and loops sections providing vertical adjustment of said biceps pad.

13. An adjustable shoulder pad as defined in claim 1 or 2, wherein said portions are made of foam material covered by layers of woven synthetic yarn.

14. An adjustable shoulder pad as defined in claim 1 or 2, wherein one of said portions comprises an external shell.

* * * * *